US005529553A

United States Patent [19]

Finlayson

[11] Patent Number: 5,529,553

[45] Date of Patent: Jun. 25, 1996

[54] TREADMILL WITH BELT TENSIONING ADJUSTMENT

[75] Inventor: Kurt E. Finlayson, Logan, Utah

[73] Assignee: Icon Health & Fitness, Inc., Logan, Utah

[21] Appl. No.: 382,341

[22] Filed: Feb. 1, 1995

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS

| | | | |
|---|---|---|---|
| 3,731,917 | 5/1973 | Townsend . | |
| 4,077,626 | 3/1978 | Newman . | |
| 4,374,587 | 2/1983 | Ogden . | |
| 4,423,864 | 1/1984 | Wiik . | |
| 4,591,147 | 5/1986 | Smith et al. . | |
| 4,616,822 | 10/1986 | Trulaske et al. . | |
| 4,729,558 | 3/1988 | Kuo . | |
| 4,886,266 | 12/1989 | Trulaske . | |
| 5,088,729 | 2/1993 | Dalebout | 482/54 |
| 5,302,162 | 4/1994 | Pasero | 482/54 |

FOREIGN PATENT DOCUMENTS 8626631 10/1986 European Pat. Off. .

OTHER PUBLICATIONS

Icon Health & Fitness, Inc. Owner's Manual for the Proform Crosswalk Advantage Treadmill model No. DRTL01040, Copyright 1994.

Assembly Instructions and Parts List for Weslo, Inc. Pulse Point Motorized Treadmill model Nos. 7110 and 7111, Copyright 1985.

Proform, Inc. Owner's Manual for the Proform Power Incline Treadmill model No. T80, Copyright 1988.

*Primary Examiner*—Lynne A. Reichard

*Attorney, Agent, or Firm*—Trask, Britt & Rossa

[57] ABSTRACT

A treadmill has an endless belt trained about a front roller and a rear roller assembly. The front roller is connected between a left frame member and a right frame member of the treadmill frame. The rear roller is also connected between the left frame member and right frame member. A bracket connects one end of the rear roller to the frame and has an adjustment mechanism operable to adjust to the front roller to reduce wander of the endless belt. Another bracket connects the other end of the rear roller to the frame and has an adjustment mechanism operable to vary belt tension on the rear roller. One bracket includes a spring operable to continuously urge one end of the rear roller away from the base so the belt tension may be adjusted using the adjustment mechanism of the other bracket.

10 Claims, 7 Drawing Sheets

TREADMILL WITH BELT TENSIONING ADJUSTMENT

BACKGROUND OF THE INVENTION

1. Field of the Invention

This invention relates to exercise treadmills, and in particular to treadmills having a frame with a rear roller assembly and an endless belt in which tensioning structure associated with the rear roller tensions the endless belt.

2. State of the Art

Typical treadmills include a continuous or endless belt trained about a pair of rollers. The belt has an upper stretch which extends over a tread base which supports a user thereon. The base is secured to a frame which generally consists of a frame having two longitudinal members joined together as by cross-members or braces secured to the longitudinal members proximate the front end and the rear end of the machine. The rollers are attached to and between the longitudinal frame members. The front or rear roller may be driven by a motor.

In the operation of a treadmill, the belt may become misaligned relative to the base. The misalignment may be the result of a variety of causes including misaligned front and rear rollers.

In order to maintain the belt in the center, the pulleys may be adjusted to vary the belt tension as disclosed in U.S. Pat. No. 5,088,729. In the '729 patent, a rear roller assembly has an adjustment screw on each end cap. The adjustment screw may be tightened or loosened at both the left side and the right side to realign the rear roller and in turn to increase or decrease the tension on the belt on the left side and the right side. By correctly manipulating the adjustment screws, the belt can be tensioned so it will maintain its relative position in the center of the roller. It may be noted that adjustment is required of two adjustment screws to effect proper tensioning of the belt and to align the belt. Proper alignment and tensioning of the belt may, therefore, be difficult to achieve through misoperation of the screws.

SUMMARY OF THE INVENTION

A treadmill has a frame that includes a left and a right frame member. The frame members are spaced apart from each other and are in substantial alignment. A tread base is attached or secured to the frame to extend between the left frame, member and the right frame member to support a user exercising thereon. A front roller is rotatably secured to and between the left frame member and the right frame member proximate the front end of the tread base. A rear roller is positioned proximate the rear end of the base and between the left frame member and the right frame member.

A left connecting mechanism connects the left end of the rear roller to the left frame member. The left connecting mechanism has left adjustment means for moving the left end of the rear roller relative to the rear end of the base. A right connecting mechanism connects the right end of the rear roller to the right frame member. The right connecting means includes a right adjustment means to move the right end of the rear roller relative the rear end of the base. The right connecting means also includes biasing means such as a spring to bias or urge movement of the right end of the rear roller relative to the rear end of the base. The endless belt has an upper stretch extending over the tread base to support a user thereon.

In a preferred embodiment, the left frame member has a rear end. The left connecting mechanism has a left end cap to connect the left frame member. The right frame member also preferably has a rear end. The right connecting mechanism has a right end cap to connect to the rear end of the right frame member.

In a preferred arrangement, the left end cap and right end cap are both formed to effect a male-female connection with the rear end of the respective left frame member and right frame member. The left adjustment means also desirably includes an adjustment member to adjust the transverse alignment of the left end of the rear roller with respect to the base. The right adjustment means also desirably includes an adjustment member to adjust the force exerted by the spring to urge the right end of the rear roller to move relative to the base.

BRIEF DESCRIPTION OF THE DRAWINGS

In the drawings which illustrate what is presently regarded as a best mode for carrying out the invention.

DETAILED DESCRIPTION OF THE PREFERRED EMBODIMENT

Figure 1:
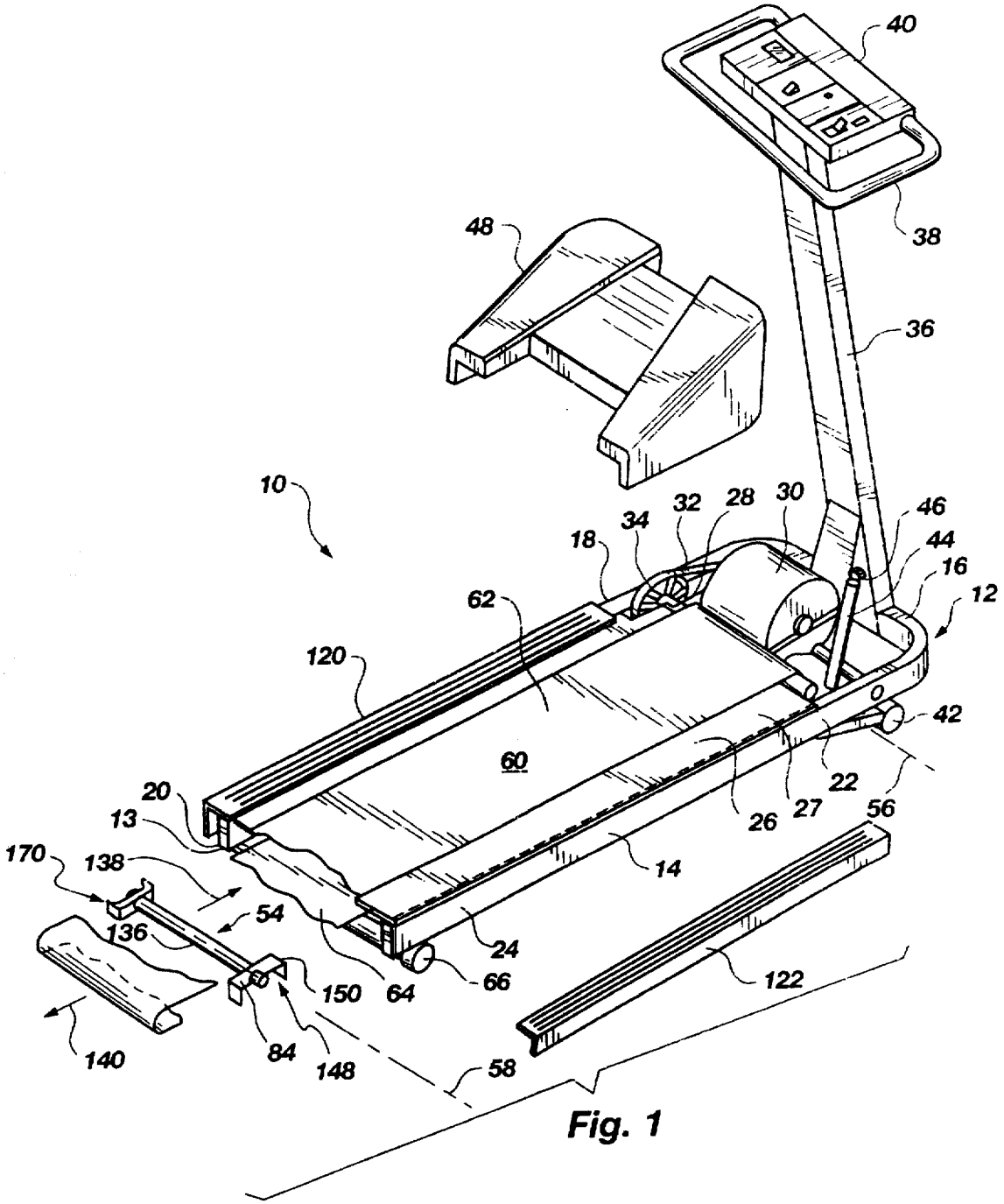
FIG. 1 is a perspective view of a treadmill of the instant invention.

The treadmill 10 of FIG. 1 has a frame 12 which includes a left frame member 13 and a right frame member 14. The left and right frame members 13 and 14 are each spaced apart from the other and in substantial alignment as illustrated.

A transverse member 16 is interconnected between the left frame member 13 and the right frame member 14. The left frame member 13 has a front end 18 and a rear end 20. Similarly, the right frame member 14 has a front end 22 and a rear end 24.

A tread deck or base 26 is attached to the frame 12 to extend between the left frame member 13 and the right frame member 14 to support an exercising user thereon. A front roller 28 is positioned in between the left frame member 13 and the right frame member 14 and between the tread base 26 and the transverse member 16.

As can be seen, the front roller 28 is positioned proximate the front end 27 of the frame and more specifically immediately forward of the tread base 26. A left safety step 120 is secured to or unitarily formed to be the left frame member 13 to extend substantially along the length of the left extension 13. A similar safety step 122 is positionable on or unitarily formed with the right frame member 14 but is here shown spaced therefrom for clarity of illustration.

Treadmill 10 includes drive means which is secured to the frame 12 and connected to rotated the front roller 28. The drive means illustrated in FIG. 1 includes a motor 30 interconnected by a pulley belt 32 to a pulley 34 secured to the front roller 28. Means may be provided to vary the speed of the pulley belt 32 by selecting a motor 30 which is a variably speed DC motor or by providing structure to mechanically vary the speed of the pulley belt 32. It may be understood that a nonmotorized treadmill may also be used if desired.

The treadmill 10 of FIG. 1 also includes an upstanding post 36 with a handle 38 and console 40 connected thereto. The treadmill 10 also includes forward wheel structure 42 which is interconnected to a cylinder 44. The cylinder 44 is connected to a bracket 46. The cylinder 44 is operable by a lever in the console 40 to urge the wheel structure 42 toward and away from the frame 12 to in turn adjust the angle of inclination of the treadmill 10. As known, by adjusting the angle of inclination, the user may adjust the degree of difficulty of the exercises being performed on the treadmill 10. Other inclination structures or systems may also be used.

In FIG. 1, a hood or housing 48 is shown in an exploded relationship with respect to the frame 12. More particularly, the housing 48 is configured to be positioned over the motor 30, cylinder 44 and the associated structure positioned forward of the tread base 26 to prevent accidental contact with moving parts and to minimize the number of surfaces and apertures into which a user might step or slip during use.

The treadmill 10 of FIG. 1 has a left connecting mechanism 170 and right connecting mechanism 148 which are secured to their respective left frame member 13 and right frame member 14 proximate the rear ends 20 and 24, respectively. A rear roller 54 is adapted to and between the left connecting mechanism 170 and the right connecting mechanism 148 in general alignment with the front roller 28 generally transverse to the left frame member 13 and right frame member 18. To be in transverse alignment, the axis 56 of the front roller 28 is substantially or functionally parallel to the axis 58 of the rear roller 54.

As may be further observed in FIG. 1, the treadmill 10 also includes an endless belt 60 which is trained about the front roller 28 and the rear roller 54 over the top of the tread base 26. The user may walk, jog or run on the endless belt 60 and thereby exercise with the weight of the user being supported by the tread base 26. The endless belt 60 has an upper stretch 62 which is positioned on top of the tread base 26 and a lower stretch 64 which extends between the front roller 28 and rear roller 54 under tread base 26. A rear foot 66 may be provided proximate the rear end 20 of the left extension 13 and the rear end 24 of the right extension 14 to support the frame 12 upon a surface.

Figure 2:
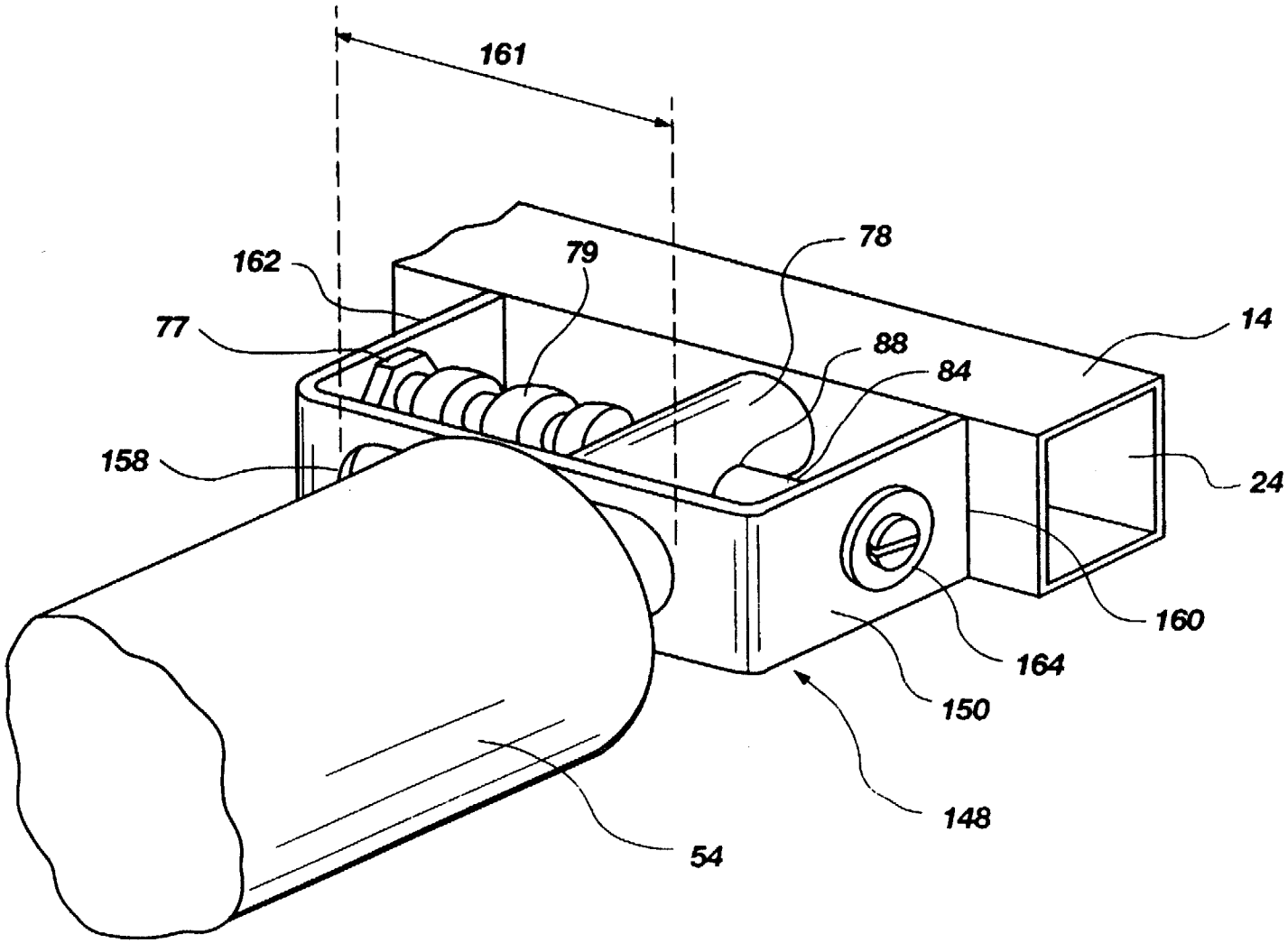
FIG. 2 shows a perspective representation of a right adjustment means associated with the rear roller of the invention.

Referring to FIG. 2, the right adjustment mechanism 148 is shown in perspective to have a right roller bracket 150. The right roller bracket 150 is attached to rear end 24 of the right frame member 14. Various means of attachment may be used including but not limited to welding or bolting the right roller bracket 150 to the right extension 14. The right roller bracket 150 has an aperture 164 located on its distal end 160 to receive a bolt 84 therethrough.

Figure 7:
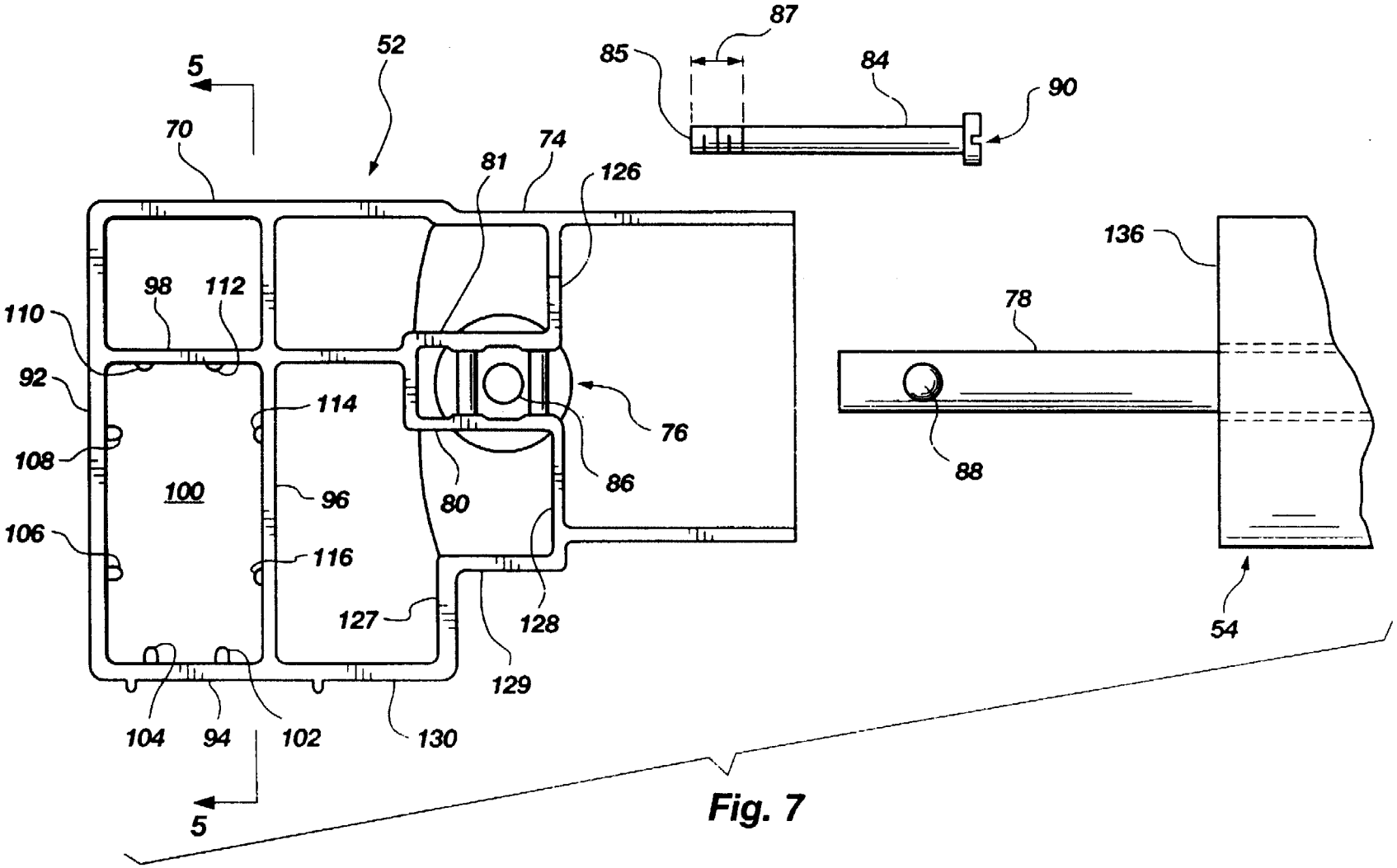
FIG. 7 is a rear view of the right roller end cap with a rear roller spaced therefrom.

The rear roller 54 has a right shaft 78 on its right end. The right roller bracket 150 also has a right shaft slot 158 to snugly receive the right shaft 78. The slot 158 is sized in length 161 to provide sufficient distance to facilitate assembly of the treadmill 10 and to provide for adjustment of the rear roller 54 in assembly and in use over time. The bolt 84 fits through the aperture 164, through an aperture 88 in the right shaft 78, through a spring 79, and into a locking nut 77 located near the proximal end 162 of the right roller bracket 150. The locking nut 77 acts as an abutment for spring 79. As shown in FIG. 7, the bolt 84 is partially threaded along a length 87 at the distal end 85. This allows the aperture 88 in the right shaft 78 to freely slide along the unthreaded portion of bolt 84 as urged by spring 79. The spring 79 here shown can be compressed by operating the belt 84 which has an operating portion positioned for external operation by a user. The operation portion has a slot so a screwdriver may be used. Other nuts, handles or levers may be used as desired. Compressing the spring 79 changes the force urging the roller 54 outward from the rear end of the base 26.

Figure 3:
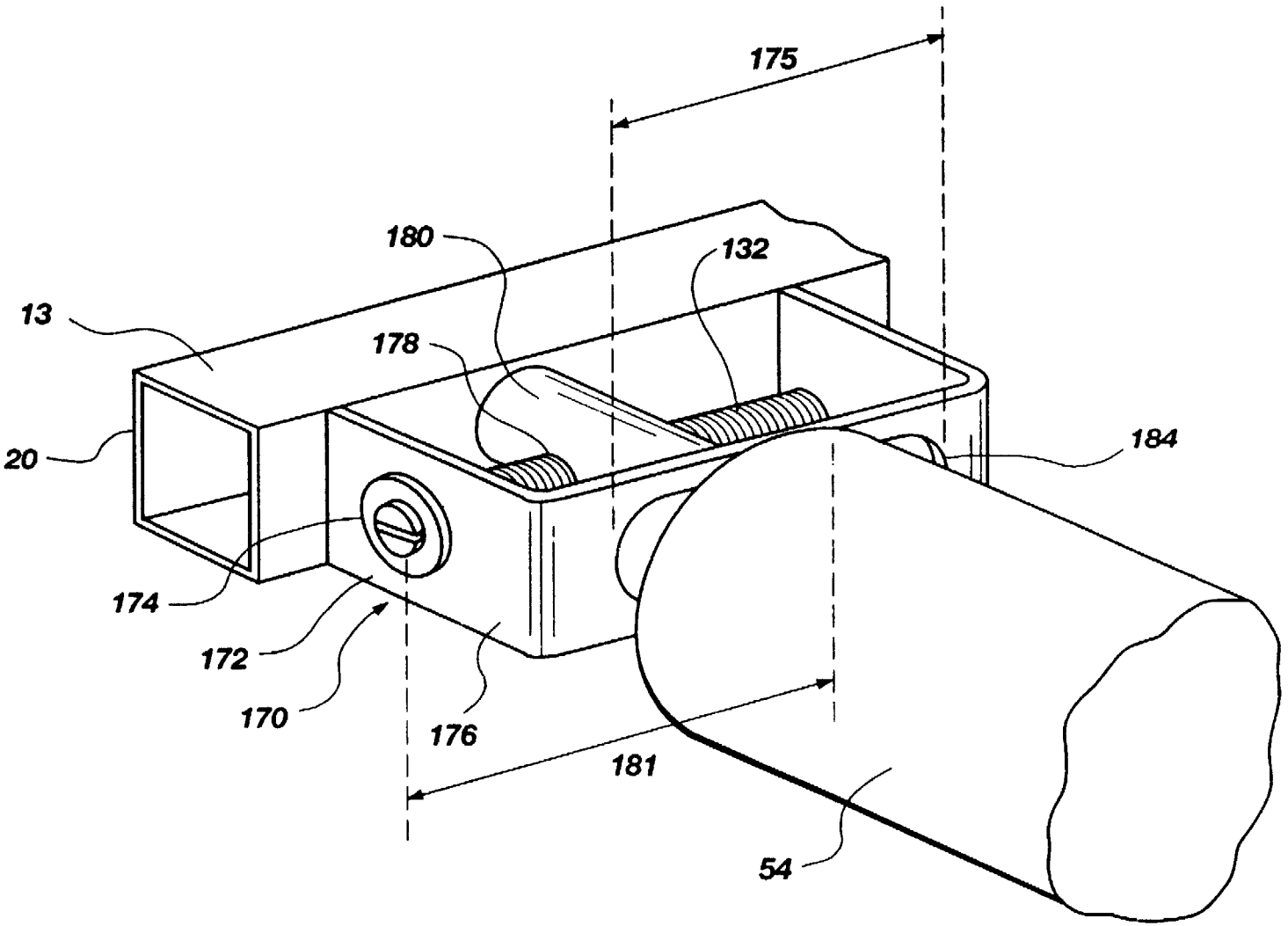
FIG. 3 shows a perspective view of a manual adjustment mechanism as attached to the rear roller and treadmill frame.

Referring now to FIG. 3, the left adjustment mechanism 170 is shown in perspective to have a left roller bracket 172. The left roller bracket 172 is attached to the rear end 20 of the left extension 13. The left roller bracket 172 has an aperture 174 located on its distal end 176 to receive a bolt 132 therethrough. The rear roller 54 includes a left slot 180 which extends outwardly therefrom. The left roller bracket 172 also has a left shaft slot 184 to receive the left shaft 180 of the rear roller 54. The slot 184 is sized in length 175 to provide sufficient distance to facilitate assembly of the treadmill 10 and to provide for adjustment of the rear roller 54. The bolt 132 is threaded along its entire length 181 and is sized to fit through the aperture 174 and through a threaded aperture 178 in the left shaft 180.

Figure 4:
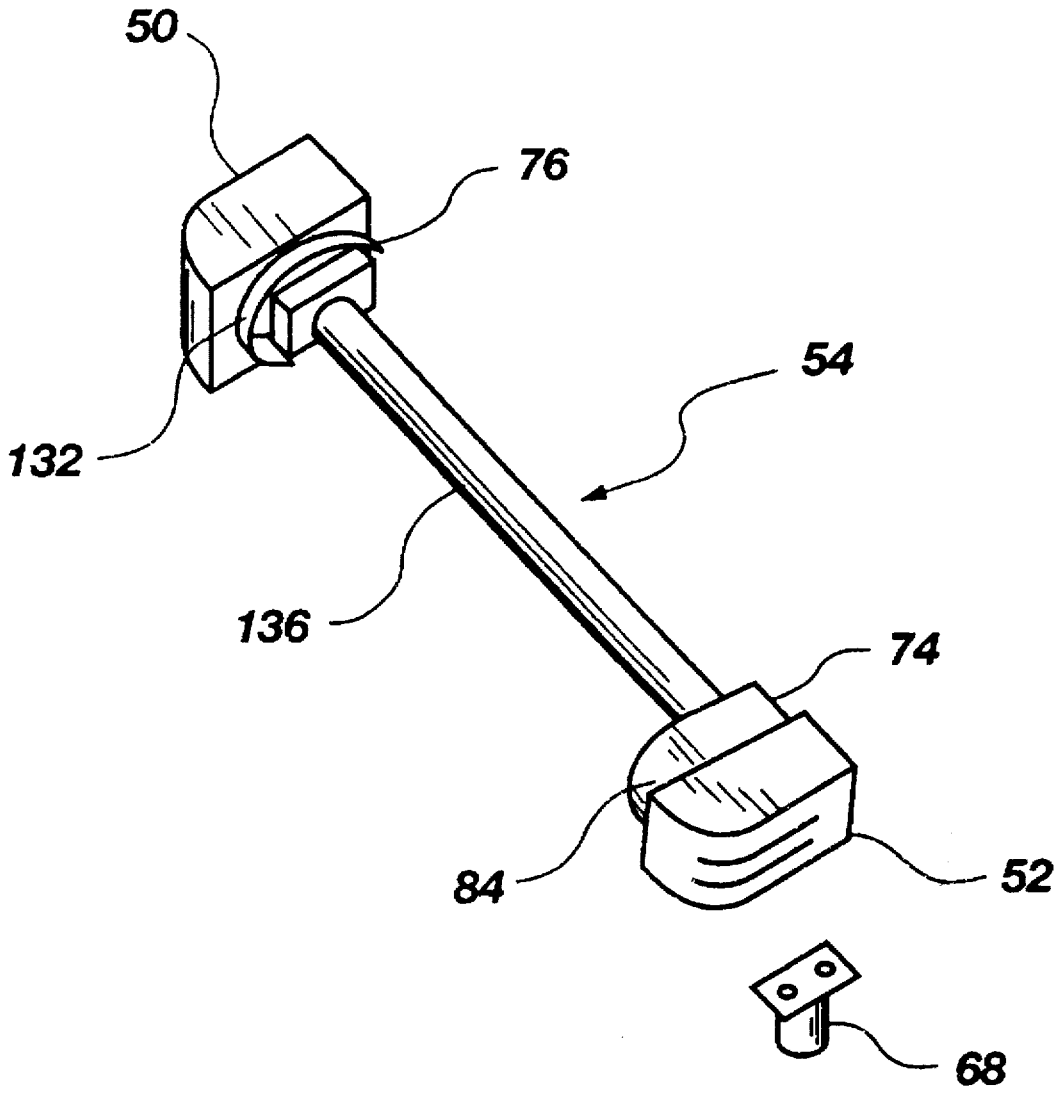
FIG. 4 is a perspective view of the left and right roller end caps as assembled to the rear roller.

Referring to FIG. 4, an alternate embodiment shows a perspective view of a right roller end cap 52 and a left roller end cap 50. The right end cap 52 has a right journal housing 74 which is oriented toward the left end cap 50 when secured to the right extension 14. The left end cap 50 has a similar end cap housing 76 which is oriented toward the right end cap 52 when the left end cap 50 is mated to the left extension 13. The rear roller 54 is adapted to and between the left journal housing and the right journal housing 74. Both the left and the right end caps 50 and 52 include adjustment means to adjust the transverse alignment of the rear roller 54 with respect to the front roller 28. A support foot 68 may be bolted to or unitarily formed to be part of the right end cap 52 and a similar foot bolted to or formed to be part of the left end cap 50 to support the frame 12 and in turn the treadmill 10 on a support surface selected by the user.

As shown in FIGS. 5 through 8, the right end cap 52 has a top surface 70 and a rear surface 72. The right end cap 52, and more particularly the right journal housing 74, includes a right shaft slot 276. The right shaft 78 of the rear roller 54 is sized to snugly fit within the slot 276. The slot 276 is formed by an upper slot member 81 and a lower slot member 80 and is sized in length 83 to provide sufficient distance to facilitate assembly of the treadmill 10 and to provide for adjustment of the rear roller 54.

Figure 5:
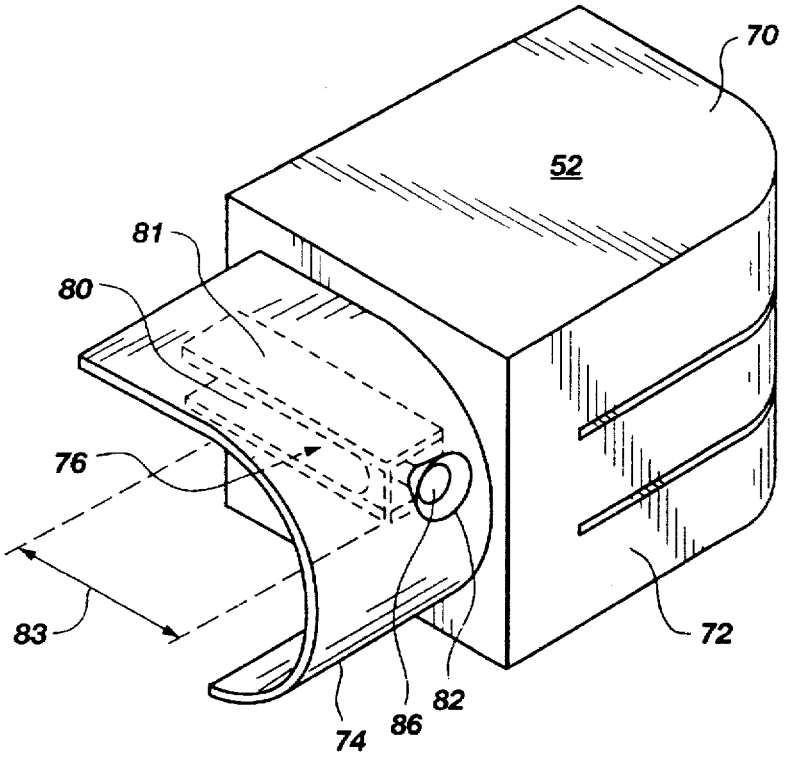
FIG. 5 shows a perspective view of the right roller end cap.

As shown in FIG. 5, the right journal housing has a recess 82 which is formed therein substantially in alignment with the slot 276. A bolt 84 is positioned through the bolt aperture 86 in the recess 82 to slide through the right shaft 78. The right shaft 78 has an aperture 88 formed therein to slidedly receive the bolt 84. The bolt 84 then slides through a spring 79 and is threadedly secured into nut 77. Thus, the shaft 78 may move along the length 83 of the slot 276 either toward or away from the rear end 24 of the right extension 14 as tension varies in the endless belt 60 of treadmill 10. As can be seen, the bolt 84 is shown with a slot 90 to receive a screw driver. The bolt 84 may also be configured to receive an allen wrench or any other mechanical device for operating a bolt.

The right end cap 52 has an outside member 92 which together with a base member 94 and internal structural members 96 and 98 form a rectilinear cavity 100 as best seen in FIG. 7. Within the rectilinear cavity 100 are a plurality of friction beads 102, 104, 106, 108, 110, 112, 114, and 116. The cavity 100 is sized with the friction beads 102 through 116 to snugly receive the rear end 24 of the right extension 14. The friction beads 102 through 116 provide for a snug frictional mating and constitute a right connector for connecting the right end cap 52 to the rear end 24 of the right extension 14. The right connector may also include a screw 118 to fasten the right end cap 52 to the rear end 24 of the right extension 14. The left end cap 50 is similarly configured to have a left connector.

Figure 8:
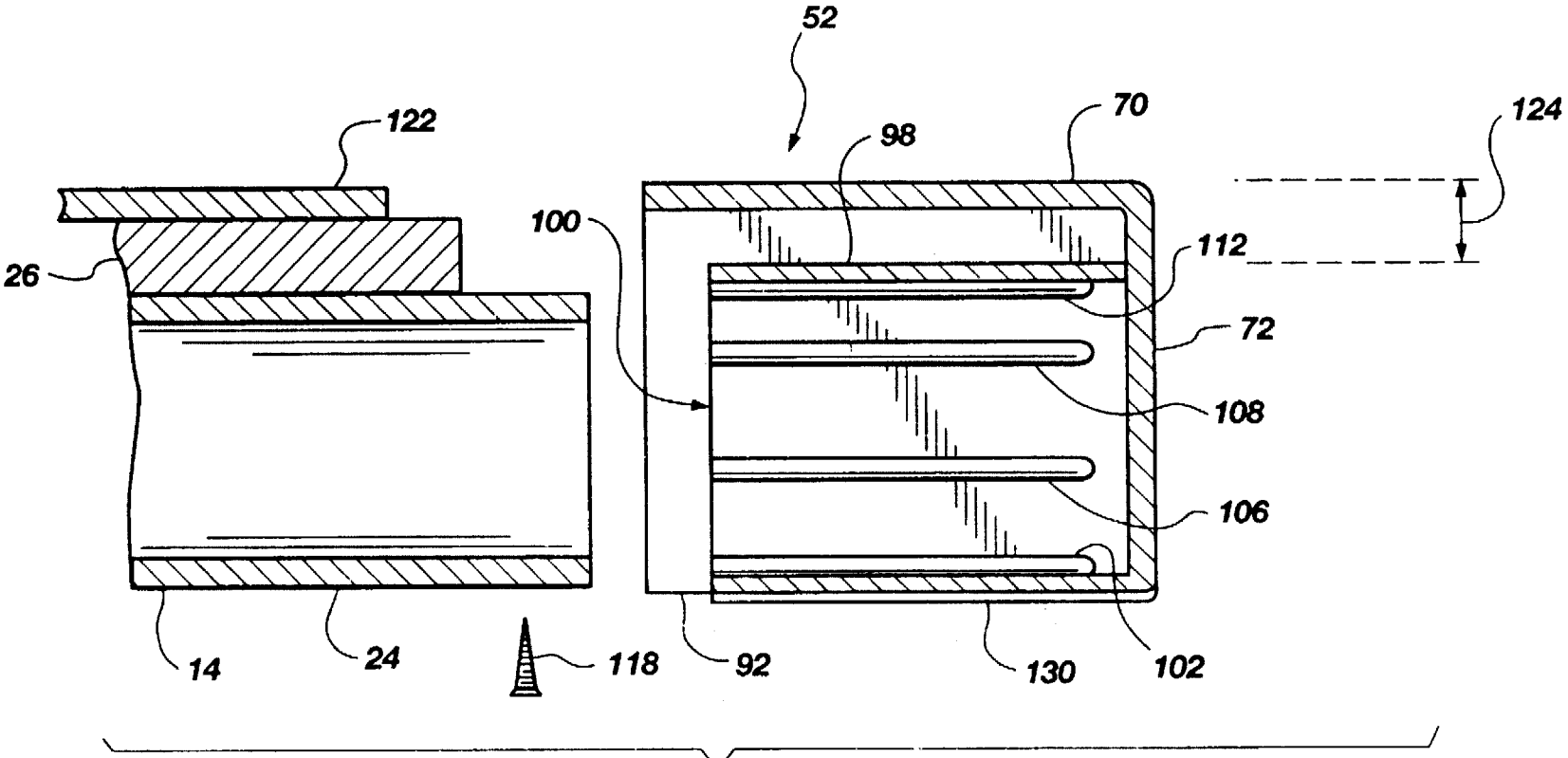
FIG. 8 shows a right roller end cap and the rear end of the right frame member of the treadmill of FIG. 1 in cross section.

In FIG. 8, the right safety step 122 is shown secured to the right extension 14 with the tread base 26 connected thereinbetween. It can be seen that the right end cap 52 and the interior upper surface 98 are spaced apart a preselected distance 124 so that the surface 70 of the right end cap 52 is substantially in alignment with the right safety step 122 when the right end cap 52 is mated with the end 24 of the right extension 14. In such a fashion, a relatively secure, smooth fit can be effected along with a smooth exterior surface. In use, the user may stand with one foot on the safety step 120 and one foot on the safety step 122 straddling the upper stretch 62 of the endless belt 60. The user may then operate the belt and cause it to move and step onto the endless belt 60 from the safety steps 120 and 122 or from the endless moving belt 60 onto the safety steps 120 and 122 as circumstances require.

Referring back to FIG. 7, the slot 276 is formed of an upper member 81 and a lower member 80. The upper member 81 is integrally formed with a vertical extension 126. The lower member 80 is connected to vertical member 128 which in turn is connected to horizontal member 129 and upright member 127. The members 126, 127, 128 and 129 together provide rigidity by interconnection to the upper surface 70 and to the lower surface 130 of the right end cap 52.

It may be noted that FIGS. 5 through 8 illustrate the right end cap 52 as shown in FIG. 4. The left end cap 50 of FIG. 4 is substantially similar to the right end cap 52 illustrated and described with respect to FIGS. 5 through 8 except that it is configured to be left handed or the mirror image of the right end cap 52 and does not include the spring 79 as part of its functionality. Rather, the bolt 84 is threaded through the aperture 178 of the left shaft 80 of the rear roller 54. Although both the left end cap 50 and the right end cap 52 are shown with a left journal housing 76 and a right journal housing 74, the adjustment means utilized by the left end cap 50 and the right end cap 52 for adjusting the transverse alignment of the rear roller 54 with respect to the front roller 28 are different. The bolt 132 associated with the left end cap 50 is threaded along its entire length 181 and is manually operable to adjust the alignment of the rear roller 54, similar to that previously described with the left roller assembly 170. On the other hand, the bolt 84 associated with the right end cap 52 is only partially threaded along its distal end 85 a distance 87 necessary to secure the right shaft 78 and the spring 79 and is used as a guide to align the spring 79 and the right shaft 78, analogous to that described with the right roller assembly 148.

As best seen in FIG. 7, the rear roller 54 has a right shaft 78 extending outwardly therefrom. The rear roller 54 has a pulley member 136 rotatably secured about the shaft 78. The right shaft 78 extends into and preferably through the pulley structure 136 to extend outwardly from the pulley structure on the left end to form a left shaft 180 similar to the right shaft 78.

In operation, the left shaft 180 as well as the right shaft 78 are inserted into their respective left and right shaft slots such as the right shaft slot 276 of the right end cap 52, as shown in FIG. 5, or the right shaft slot 158 of the right roller assembly 148, as shown in FIG. 2. A bolt such as bolt 132 is threadedly interconnected with the aperture 178 on the left side to assembly the manual adjustment means, and another bolt, such as bolt 84, is slid through the aperture 88 through spring 79 and secured by locking nut 77 to assembly the automatic adjustment means.

The rear roller 54, and more particularly the pulley 136, is positioned between the upper stretch 62 and the lower stretch 64 (FIG. 1). The associated roller assemblies 148 and 170 or end caps 50 and 52 are positioned to mate with the rear end 24 of the right extension 14 and the rear end 20 of the left extension 13. The endless belt 60 urges the pulley 136 towards 138 the extensions 13 and 14. The bolt 132 is operated to draw the rear roller 54 outwardly 140 away from the rear end 20. Likewise, the spring 79 forces the rear roller 54 outwardly 140 away from the rear end 24. Thus, the bolt 132 and the spring 79 snugly secure the belt 60 over the tread base 26. Appropriate operation of the bolt 132 facilitates alignment and the retention of the belt 60 centrally on the pulley 136. That is, slight transverse misalignment allows the endless belt 60 to wander towards the left or to the right extensions 13 and 14. Appropriate adjustment of the bolt 132 may be used to reduce the tendency of the belt to wander along the pulley 136.

In describing the several embodiments, it should be understood that the left connecting mechanism and the right connecting mechanism are terms used for convenience of description. The structures are interchangeable in that what has been described as the left connecting mechanism may be positioned on the right and vice versa. That is, a mechanism or structure comparable to that shown in FIG. 2 for use on the right side may instead be used on the left side. Of course one may also use a structure such as that shown in FIG. 2 on both sides of the rear roller.

It may be understood that the above-described embodiments are not intended to limit the scope of the claims which themselves recite those features which are regarded as essential to the invention.

What is claimed:

1. An exercise treadmill comprising:

a frame having left and right frame members;

a front roller connected to and between said left and right frame members;

a rear roller having a left end and a right end positioned between said left and right frame members;

an endless belt being moveable and trained about said front roller and said rear roller;

a left connecting means for connecting said left end of said rear roller to said left frame member, said left connecting means having a left adjustment means for moving said left end of said rear roller relative to said front roller; and a right connecting means for movably connecting said right end of said rear roller to said right frame member, said right connecting means having right adjustment means for movement of said right end of said rear roller relative to said front roller and a right biasing means for continuously urging said right end of said rear roller away from said front roller.

2. The exercise treadmill of claim 1 wherein said right biasing means includes a spring positioned to continuously urge said right end of said rear roller away from said front roller.

3. The exercise treadmill of claim 2 wherein said left frame member has a rear end and said left connecting means includes a left end cap adapted to connect to said left frame member proximate said rear end of said left frame member.

4. The exercise treadmill of claim 3 wherein said right frame member has a rear end and said right connecting means includes a right end cap adapted to connect to said right frame member proximate said rear end of said right frame member.

5. The exercise treadmill of claim 4 wherein said left end cap and said rear end of said left frame member are formed for effecting a male-female interconnection.

6. The exercise treadmill of claim 5.wherein said rear end of said right frame member and said right end cap are formed for effecting a male-female interconnection.

7. The exercise treadmill of claim 6 wherein said left adjustment means includes an adjustment member having an operation portion positioned to be external of said left connecting means and an internal portion connected to said left end of said rear roller.

8. The exercise treadmill of claim 7 wherein said right adjustment means includes an adjustment member having an operation portion positioned to be external of said right connecting means and an internal portion connected to move said right end of said rear roller relative to said front roller, and wherein said spring exerts a force which is adjustable by operation of said adjustment member.

9. The exercise treadmill of claim 1 further including a base secured between said left and right frame members to support a user thereon with said endless belt having a portion positioned over said base.

10. A rear roller assembly for use in an exercise treadmill comprising:

a left end cap and a right end cap attached to and between a left distal end and a right distal end of a left frame member and a right frame member of a treadmill, respectively;

a left shaft slot and a right shaft slot formed in said left end cap and said right end cap, respectively;

a rear roller member having a left end and a right end rotatably secured in and between said left shaft slot and said right shaft slot, respectively;

left adjusting means adapted to said left end cap for adjusting the position of said left end of said rear roller member; and right adjusting means adapted to said right end cap for adjusting the position of said right end of said rear roller member, said right adjusting means including biasing means positioned for continuously urging said right end of said rear roller member away from a front roller member of a treadmill.

* * * * *

UNITED STATES PATENT AND TRADEMARK OFFICE

CERTIFICATE OF CORRECTION

PATENT NO. : 5,529,553
DATED : June 25, 1996
INVENTOR(S) : Kurt E. Finlayson

It is certified that error appears in the above-indentified patent and that said Letters Patent is hereby corrected as shown below:

In col. 1, line 49, delete the comma after "frame";

In col. 1, line 62, after "relative" insert --to--;

In col. 3, line 39, change "18" to --14--;

In col. 4, line 10, change "belt" to --bolt--;

In col. 4, line 21, after "left" change "slot" to --shaft--;

In col. 4, line 38, after "housing" (first occurrence) insert --76--;

In col. 5, line 47, change "80" to --180--;

In col. 6, lines 9 and 11, change "assembly" to --assemble--;

In col. 6, line 38, insert a comma after "course";

In col. 7, line 17, delete the period after "5";

In FIG. 5, change "76" to --276--; and

Figure 6:
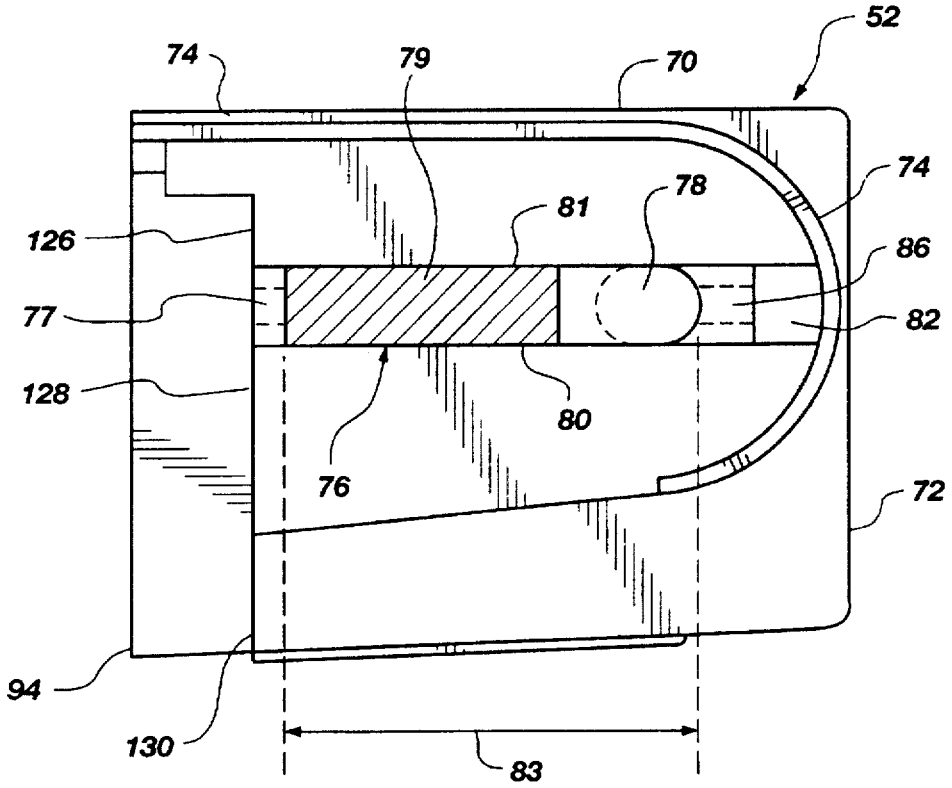
FIG. 6 is a side view of the right roller end cap.

In FIG. 6, change "76" to --276--.

Signed and Sealed this

Tenth Day of December, 1996

*Attest:*

Bruce Lehman

BRUCE LEHMAN

*Attesting Officer*

*Commissioner of Patents and Trademarks*